US005321201A

United States Patent [19]

Noreen

[11] Patent Number: 5,321,201

[45] Date of Patent: Jun. 14, 1994

[54] MULTISOUND LAP STEEL GUITAR

[76] Inventor: John S. Noreen, 1862 Wilson Pike, Franklin, Tenn. 37064

[21] Appl. No.: 997,573

[22] Filed: Dec. 28, 1992

[51] Int. Cl.[5] ..... G10H 1/06

[52] U.S. Cl. ..... 84/735; 84/742; 84/312 P

[58] Field of Search ..... 84/312 P, 312 R, 726, 84/735, 741, 742

[56] References Cited

U.S. PATENT DOCUMENTS

| | | | |
|---|---|---|---|
| 3,478,158 | 11/1969 | Trainor . | |
| 3,544,696 | 12/1970 | Broussard . | |
| 4,372,187 | 2/1983 | Berg | 84/722 |
| 4,480,520 | 11/1984 | Gold | 84/735 |
| 4,711,149 | 12/1987 | Starr | 84/742 |
| 5,136,918 | 8/1992 | Riboloff | 84/723 |
| 5,136,919 | 8/1992 | Wolstein | 84/742 |
| 5,200,569 | 4/1993 | Moore | 84/723 |
| 5,233,123 | 8/1993 | Rose et al. | 84/726 |

*Primary Examiner*—William M. Shoop, Jr.
*Assistant Examiner*—Jeffrey W. Donels
*Attorney, Agent, or Firm*—Abe Hatcher

[57] ABSTRACT

A lap steel guitar having two hidden pickups at least halfway along the neck of the guitar underneath the fret board and electrically connected to a conventional fret board circuit so that, by a volume, control and a tone control, a new sound from the two hidden pickups may be mixed with sound from the conventional circuit when the strings of the guitar are strummed.

9 Claims, 2 Drawing Sheets

MULTISOUND LAP STEEL GUITAR

BACKGROUND OF THE INVENTION

1. Field of the Invention

This invention relates to a steel guitar. More particularly, it relates to a lap steel guitar with a new sound.

2. Description of the Prior Art

A conventional steel guitar has only one or two basic sounds. It is desirable to have as many sounds as possible coming from a single guitar.

SUMMARY OF THE INVENTION

After extended investigation I have come up with a lap steel guitar from which I can get three different basic sounds plus a combination of sounds. This prevents changing guitars to go from one sound to another. I obtain these three basic sounds by employing two hidden pickups at least half way along the neck of the guitar toward the body and preferably with one spaced between the 12th and 14th and the other between the 18th and 20th frets (lines). One advantage of my invention is that I can use only two switches to mix and combination of sounds which I produce with my two hidden pickups. I employ one circuit or circuit board in addition to the conventional circuit to produce the enhanced sound. With my hidden pickups I produce a sound like a dobro, which is a special acoustic slide guitar, thereby enabling a single guitar to make two types of sound, that of a conventional lap steel guitar, plus a "rock" sound produced by the two new pickups.

BRIEF DESCRIPTION OF THE DRAWING

For a better understanding of my invention reference will be made to the drawing, in which.

DETAILED DESCRIPTION OF THE INVENTION

Figure 1:
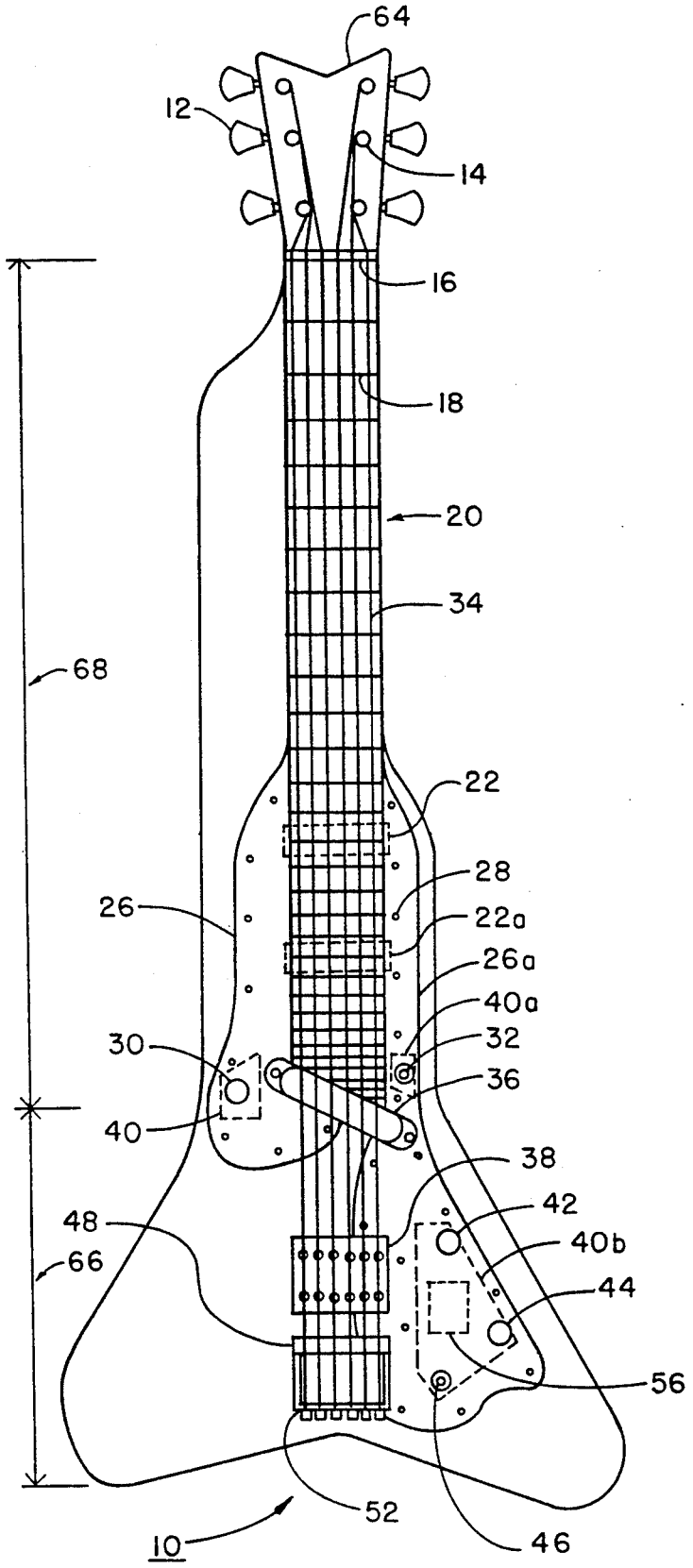
FIG. 1 is an plan view of the multi sound steel guitar of the invention.
Figure 2:
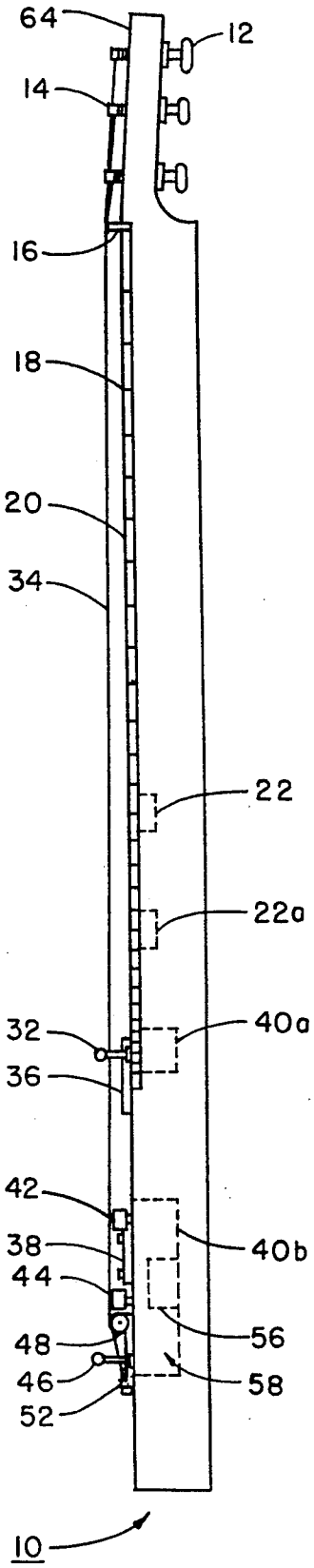
FIG. 2 is a elevation view of the multi sound steel guitar of the invention.

In FIGS. 1 and 2 of the drawing, the multisound lap steel guitar 10 of the invention is divided generally into two parts, neck 68 and body 66 and includes, beginning at head 64, which has thereon tuning grips 12 and tuning pegs 14, nut 16, fret or fret mark 18, fret board 20, strings 34, hidden pickup 22, hidden pickup No. 2 **22*a*, pick guards 26, 26*a* with screws 28 for attaching them, multisound volume control 30, (variable resistance here 50 k), pick up selector switch 32, neck pickup 36, bridge double pickup 38, cavities 40, 40*a* and 40*b* for multisound volume control 30, pickup selector switch 32, and amplifier IC and related circuitry, master volume control (variable resistance here 500) 42, tone control 44, (variable resistance 250), bridge pickup coil switch (3-way) 46, bridge 48, hidden multisound circuitry involved in obtaining the new sound 56, bridge 48 and tail piece 52** for anchoring strings.

Figure 3:
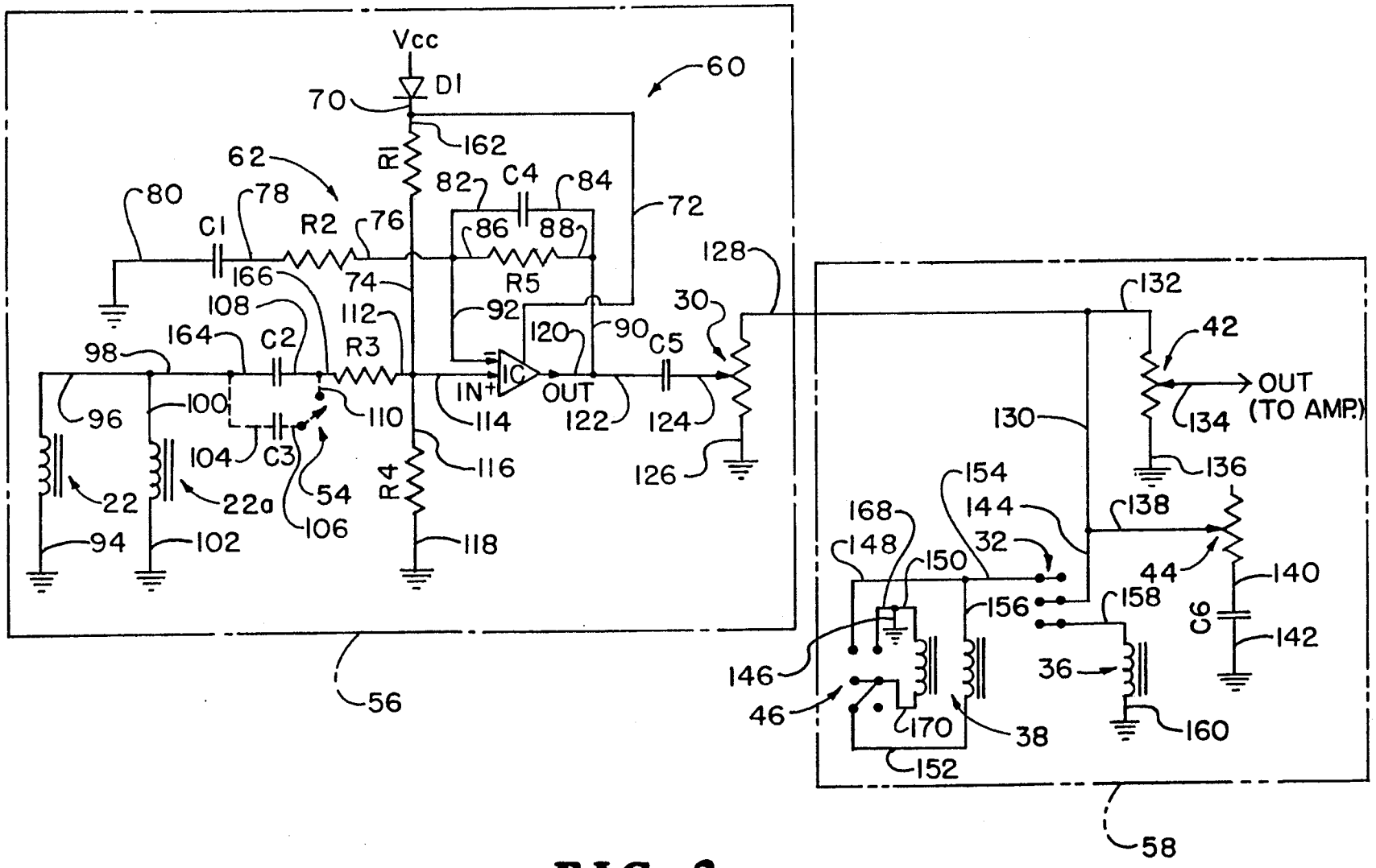
FIG. 3 is a schematic diagram of the electric circuit involved in producing the new sounds.

In FIG. 3 is depicted the conventional circuitry 58 required for any lap steel guitar plus representative circuitry 56 including the two hidden pickups 22, **22*a* which I use to bring about the new sound or combination of sounds obtained from my multisound lap steel guitar. The conventional circuitry portion 58 includes bridge double pickup 38 which may be used in parallel in series or singly and neck pickup 36, operated by pickup selector switch 32 (See FIGS. 1 and 2) and 3-way bridge pickup coil switch 46 which is connected to the separate coils of bridge pickup 38 by respective lines 150 and 170. Bridge pickup 38 is also connected by line 150 to a ground 146, line 168 running from that point to 3-way bridge pickup coil switch 46. Line 156 from the bridge pickup 38 joins line 148 coming from, 3-way bridge pickup coil switch 46 and goes on from there to pickup selector switch 32 (See FIGS. 1 and 2) from which line 158 leads to neck pickup 36, grounded at 160. Line 152 goes from bridge pickup coil switch 46 to bridge pickup 38 as does line 170 via a different coil connection. From multisound volume control 30 by which sound from the multisound circuitry 56, may be blended with sound from the conventional network 58 to get all new sound, all old or a mixture of old and new sound line 128, leads to a juncture with lines 130 and 132 of the conventional circuitry the former going to a point where it meets 138 and 144, and the latter going to the master volume control (variable resistance, 500 k) 42 (grounded at 136) from which line 134 leads to an outside amplifier (not shown), used to get the desired sound amplification and tone or sound mixture when playing the guitar. From the juncture of lines 130, 138 and 144, line 144 goes to pickup selector switch 32 (See FIGS. 1 and 2). From the same point line 138 leads to tone control (variable resistance, 500 k) 44 grounded at 142 via line 140 and condenser C6. In the multisound circuitry of the invention 56 depicted in FIG. 3 beginning at the left, line 96 leaves hidden pickup 22, grounded at 94, and joins a similar line 100 coming from the hidden pickup 22*a*, grounded at 102, becoming line 98 ending where line 164 begins and leads to condenser C2, alternate line 104 for alternate tonal quality beginning where line 98 ends and leading to condenser C3, from which line 106 goes to tone modifier switch 54, which, when closed permits current to go via line 110 back to main line 166, a continuation of line 108 coming from C2 condenser, line 166 continuing, after passing through resistor 3, as line 112, which is an ongoing line 114 to the positive terminal of 1C amplifier, line 116 leading from the juncture of line 112 and line 114 to R4 resistor and being grounded at 118. Current comes from power source Vcc, for example, a 9-volt battery, through diode D1 via line 70, R1 resistor and line 74 to the juncture of lines 112, 114 and 116. Electricity leaves amplifier 1C via line 120 and continues via line 90, line 84, condenser C4, line 82 and line 92 to the negative terminal of 1C amplifier or via line 88, R25 resistor, line 86 and line 92, with line 76 going to R2 resistor and then via line 78, C1 condenser and line 80 to ground. After a juncture with line 90 line 120 continues as line 122 to C5 condenser and then as line 124 to multisound volume control (variable resistance, 50K) 30, which is grounded at 126, line 128 leaving this point 30 for conventional circuit 58, to enable mixing of old sounds of the conventional circuit 58 with the new sounds of the hidden electromagnetic coil pickups 22, 22*a* of my multisound circuit 56. In circuit 60 electric line 72, leaving line 70** shortly after it leaves diode D1 at energy source Vcc, goes directly to amplifier IC.

With respect to the actual production of the new sound brought about by the lap steel guitar of the invention, picking or strumming strings 34 above pickups 22 and **22*a* cuts the magnetic line of force of the pickups to induce an ac voltage within the coils of each electromagnetic pickup 22, 22***a* that corresponds to the frequency of the strings above. Current from pickup 22 goes via line 96 and current from pickup 22*a* via line 100 to line 98, from which it may go either through C2 condenser directly to line 164 and on via line 108 to C2 condenser and then via line 166 to resistor R3 and line 112 to amplifier IC via line 114, or via line 104 to condenser C3, then via line 106 tone control switch (alternate route) and line 110 back to main line 166 and on to amplifier IC by the route already given. Leaving amplifier IC, current moves via lines 120, 122 and condenser C5 to multisound volume control 30, which, by way of its connection to conventional circuit 58 by lines 128, 130 and 132, is used to blend and control the amount of sound from the conventional circuit 58 and from the new circuit 56.

While the invention has been described in terms of preferred embodiments, the claims appended hereto are intended to encompass all embodiments which fall within the spirit of the invention.

Having thus described my invention and certain preferred embodiments thereof, I claim:

1. A multisound lap steel guitar which comprises in cooperative combination and in respective order from top downward and going along an entire length of said guitar a head in which are inserted tuning pegs and tuning grips, a fixed nut or prominence at an upper end of strings, a neck furnished with frets or ridges on a fretboard, the neck connecting the head and a body which comprises substantially all of the remainder of said guitar and has a bridge near a lower end thereof having a tailpiece for anchoring the strings, said guitar also comprising a conventional circuit for obtaining a steel lap guitar tone, a variable resistance tone control and two hidden pickups in a circuit supplied with electricity from an electricity source spaced underneath said fret board at least halfway along said neck toward a body end of said guitar and connected by an electric line to said conventional circuit to blend sounds from said conventional circuit with sounds from said circuit supplied with electricity.

2. The lap steel guitar of claim 1 wherein a first of said two pickups for obtaining a sound effect is placed between a 12th and 14th of said plurality of frets and a second of said two hidden pickups is placed between an 18th and 20th of said plurality of frets.

3. The lap steel guitar of claim 1 wherein said two hidden pickups are a part of said circuit supplied with electricity from an electricity source and having as a part thereof an amplifier, a plurality of condenser and a plurality of resistors.

4. The lap steel guitar of claim 1 wherein said conventional circuit comprises two electric lines adapted to be switched into said electrical circuit, a first of said two lines going to a juncture of two additional lines, the first of said two additional lines going to a pickup selector switch and connectible thereby to a double bridge pickup and the second of said two additional lines going to a variable resistance tone control, a second of said two electric lines going to a variable resistance master volume control connected to an amplifier.

5. The lap steel guitar of claim 1 wherein said circuit supplied with electricity includes a volume control and is connected with said conventional circuit, whereby amounts of sound from the conventional circuit may be blended with amounts of sound from the circuit supplied with electricity to form a combination of sounds.

6. The lap steel guitar of claim 2 wherein said two hidden pickups comprise, in electrical interconnection, two electromagnetic coils connected by way of a first condenser, a resistor, a wide range amplifier and a second condenser, to a variable resistance volume control.

7. The lap steel guitar of claim 6 wherein said first condenser has in association therewith a second condenser connected thereto by a tone modifier switch.

8. The lap steel guitar of claim 6 wherein said two hidden pickups are connected to a standard lap steel guitar sound circuit.

9. In a lap steel guitar comprising in cooperative combination and in respective order from top downward and going along an entire length of said guitar a head in which are inserted tuning pegs and tuning grips, a fixed nut or prominence at an upper end of strings, a neck furnished with frets or ridges on a fretboard, the neck connecting the head and a body which comprises substantially all of the remainder of said guitar and has a bridge near a lower end thereof having a tailpiece for anchoring the strings, a conventional circuit for obtaining a steel lap guitar tone, the improvement which comprises two hidden pickups in a circuit supplied with electricity from an electricity source underneath said frets, a first of said two hidden pickups being placed between a 12th and 14th of said frets and a second of two hidden pickups being between an 18th and 20th of said frets, said circuit supplied with electricity from an electricity source including an amplifier for improving tone, a plurality of condensers and a plurality of resistors with electricity supplied from a battery, and said circuit supplied with electricity from an electricity source being connected to said conventional circuit by an electric line to blend sounds from said conventional circuit with sounds from said circuit supplied with electricity.

* * * * *